US005679104A

United States Patent [19]

Driscoll

[11] Patent Number: 5,679,104

[45] Date of Patent: Oct. 21, 1997

[54] ISOMETRIC EXERCISING APPARATUS

[75] Inventor: Larry James Driscoll, Delta, Canada

[73] Assignee: Larry Driscoll, Canada

[21] Appl. No.: 540,189

[22] Filed: Oct. 6, 1995

[51] Int. Cl.[6] ..... A63B 21/002

[52] U.S. Cl. ..... 482/91; 482/38; 482/1

[58] Field of Search ..... 482/5–7, 38, 91, 482/133, 148, 907, 908, 1

[56] References Cited

U.S. PATENT DOCUMENTS 4,720,099 1/1988 Carlson ..... 482/133

4,869,497 9/1989 Stewart et al. ..... 482/5

4,898,381 2/1990 Gordon ..... 482/908 X

*Primary Examiner*—Richard J. Apley

*Assistant Examiner*—John Mulcahy

[57] ABSTRACT

An isometric exercise apparatus includes a pair of exercise mechanisms adjustably mounted along parallel slanted tracks. Each mechanism has an arm pivotally mounted thereto. A torque ratchet or geared solenoid is used to lock the arms in angular position. A push bar connects the arms for the user to engage in isometric exercise. A counterweight mechanism provides for fluid movement of the exercise mechanisms substantially in unison along the slanted track.

4 Claims, 12 Drawing Sheets

FIG.2
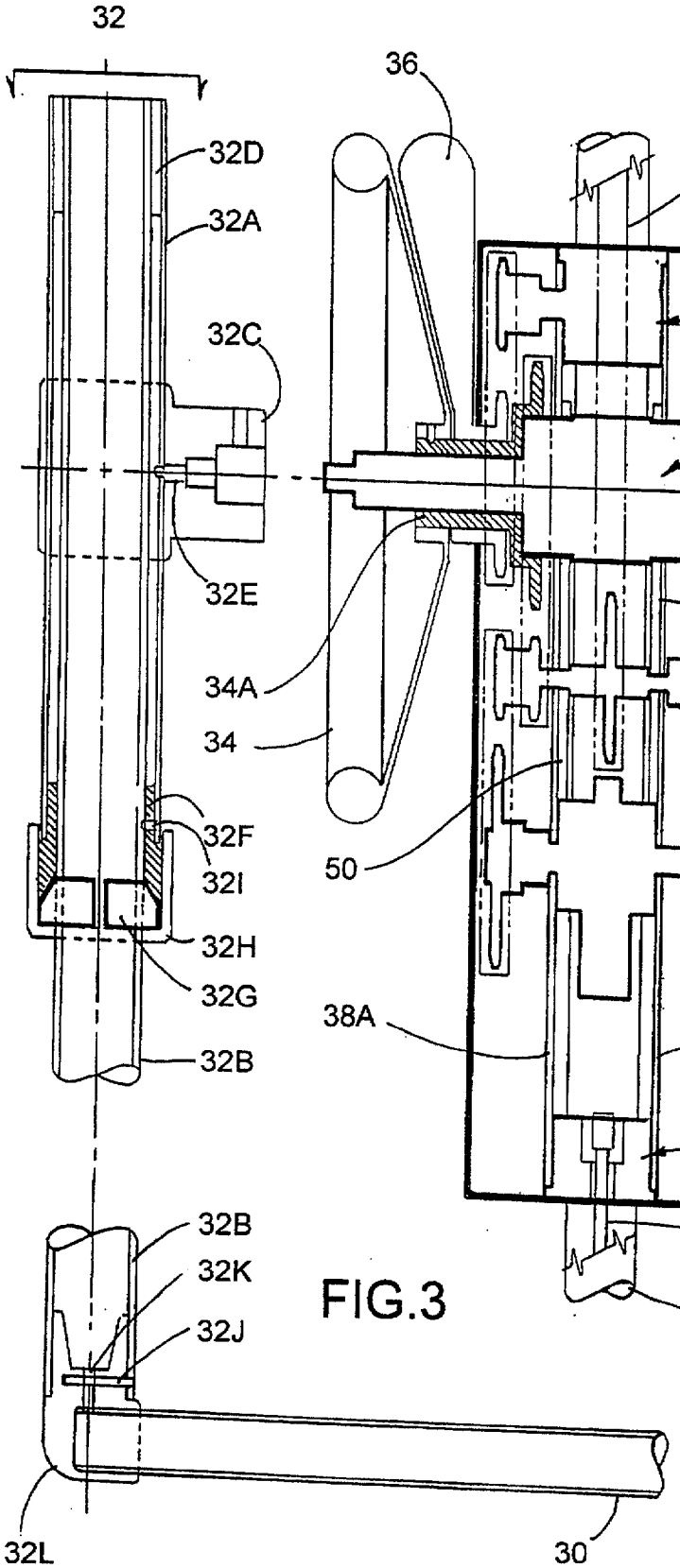
FIG.4
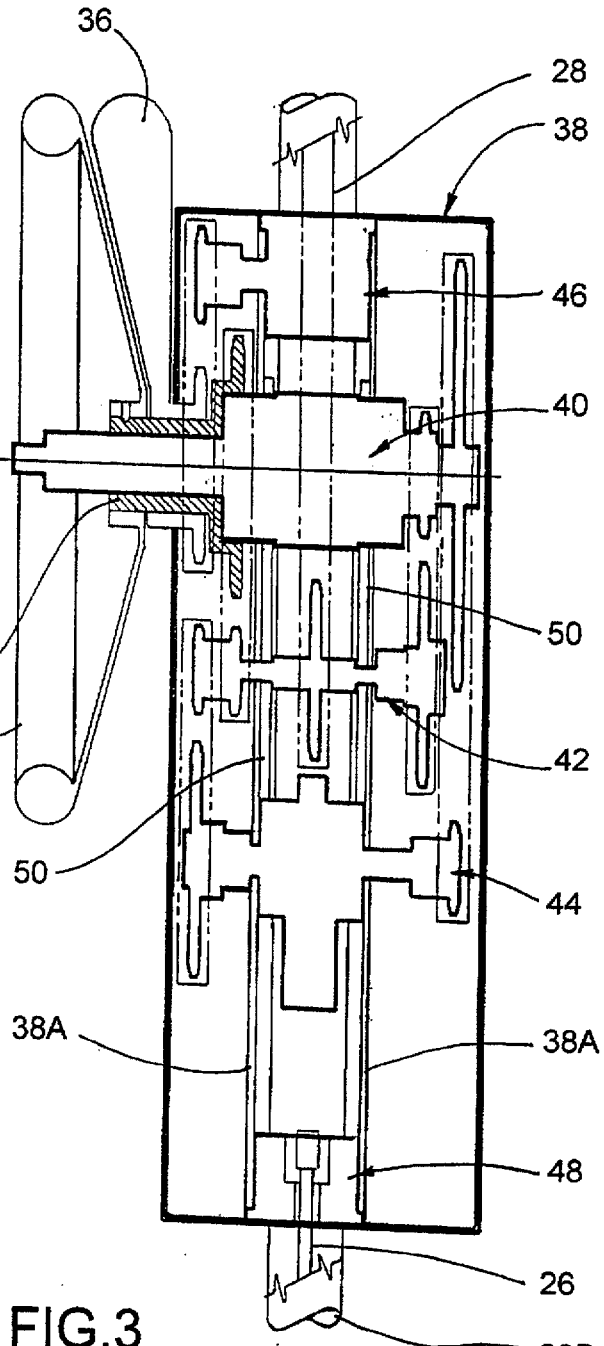
FIG.3

A-A

C-C

B-B

FIG.14
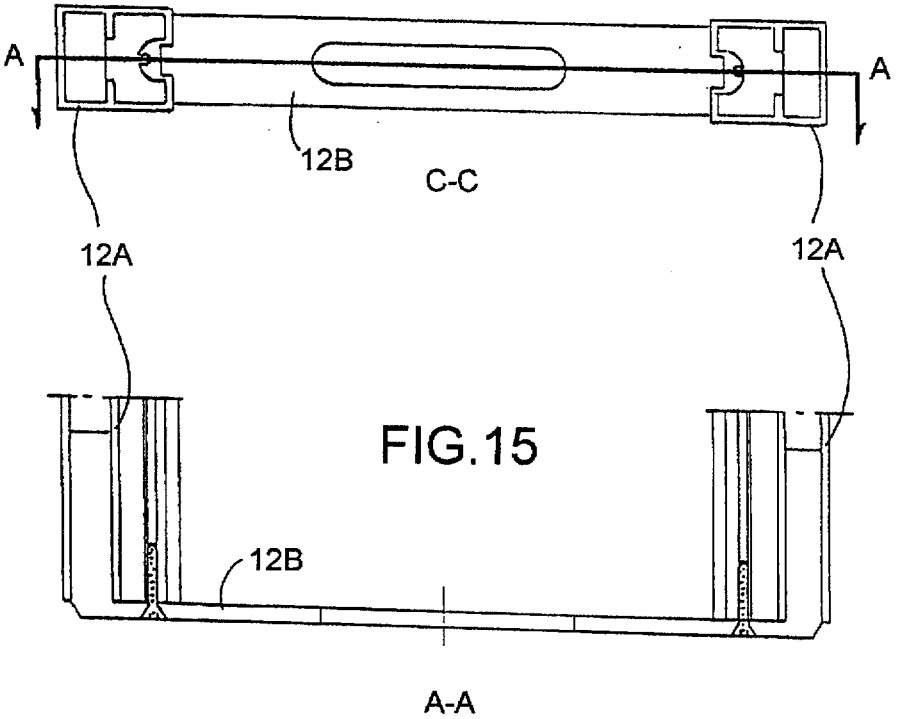
FIG.15
FIG.16
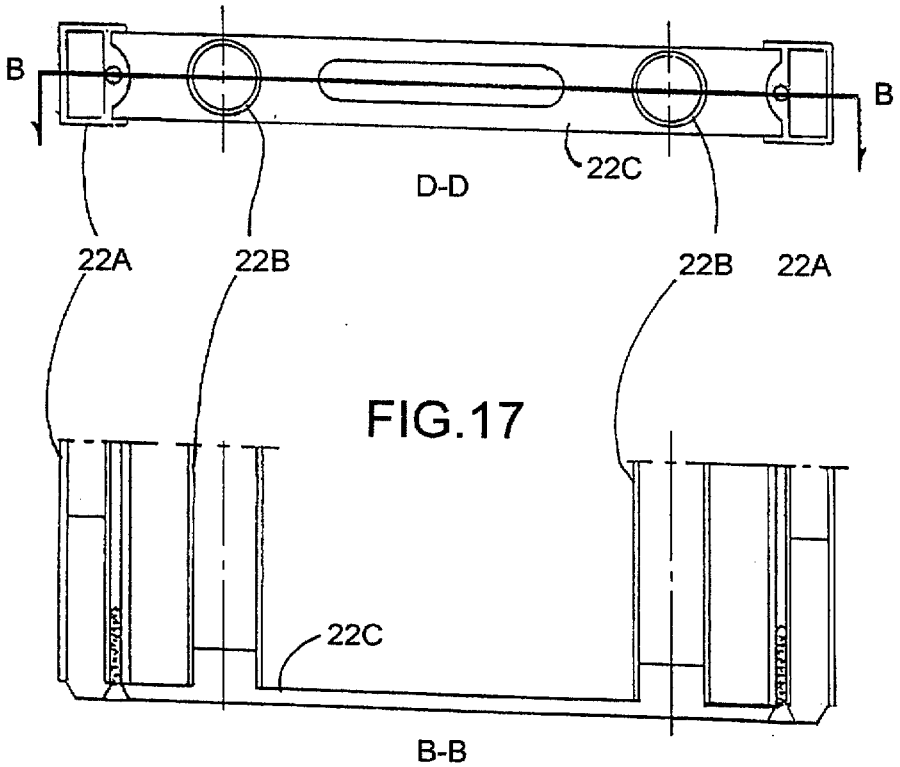
FIG.17

A-A

ISOMETRIC EXERCISING APPARATUS

BACKGROUND AND SUMMARY OF THE INVENTION

This invention relates to exercise equipment, and more particularly to an exercise device for the development of physical strength through isometric contractions. An isometric contraction is basically a contraction where the muscle is unable to produce any movement or work upon a load. This is in contrast to the more common isotonic form of exercise. Isotonic contraction, strictly speaking, means constant tension. However, because the muscle contractions involving the lower arm and joints are not under constant tension, a loose definition would be a contraction where the internal force produced by the muscle exceeds the external force of the load. During an isotonic contraction, sometimes called a concentric contraction, work is said to be done. The study by Asmusen, along with numerous others, found a high correlation between isotonic and isometric strength, so that the maximum isotonic strength can be roughly predicted from the simpler measurement of the maximum isometric strength of the same muscle.

When training for strength, one is continually increasing the magnitude of the load to the maximum. It is at this point when the muscle contracts isometrically. During isotonic exercises, the constant flexing of the muscle tends to increase endurance by subjecting the oxygen transport system to stress while having little effect on the strength of the muscles involved. According to studies, during the course of training isotonically the increased strength of a muscle must come from the progressive stimulation of the total muscle fiber. It is at this point when the stimulus becomes sufficient to excite all the fibers in a muscle that the resulting tension causes the capillaries to become compressed and the oxygen supply to become inadequate. The muscles are then said to be contracting isometrically. The oxygen deficit that occurs at this point seems to be an important factor in the acquisition of muscle strength. Reports from E. A. Muller's laboratory in Germany have made a great impact upon methods of muscle training. In one study, in a previously untrained biscep muscle, isometric contractions induced a near 100% increase in strength and a 25% increase in the cross-sectional area of the arm after 100 days of 10 second contractions, 6 days a week, 3 times per day; a total time of 50 minutes. Ongoing studies seem to indicate that daily isometric contractions continued for 6 seconds and utilizing only ⅔ of the muscle's maximum strength will give the best results in gaining strength. Their studies also indicate that muscle tissue seem to display a sense of memory when it comes to the isometric development of strength in that, if one contracts only in one position, in the example of the bicep contraction, the muscle strength peaks at that one position. Move up or down from that position and the acquired strength of the same muscle tends to decrease. So the more positions or areas of strength developed isometrically throughout the entire range of an exercise, such as arm curls, as opposed to just a static bicep contraction, leads to the overlapping positions of strength and ultimately to an enhancement of the overall isotonic strength of the muscle.

Now considering again this sense of memory that a muscle seems to acquire we find this phenomena at work in all sports, indeed, in all activities. Where a certain coordinated set of muscle contractions are required to perform any activity, be it golf, gymnastics, swimming, dance etc., there is one and only one set of coordinated muscle contractions that allows for a perfect performance in any activity. This level of performance is acquired or at least approached by repeating the activity over and over again until these coordinated set of muscle contractions are memorized such that the muscles involved in performing the activity contract more strenuously through numerous critical positions that provide an exact line of strength that produces results that approaches a perfect performance of the activity. Sporting activities are basically made up of smaller routines that are performed in a variety of ways throughout the activity. And when practiced, the activity is then broken down into these simpler segments which are then repeated until they are perfected. This extremely repetitious form of practice or exercise is totally isotonic and the results are hit and miss at best. Although this form of practice cannot be replaced it can be enhanced through the combined use of the more precise form of isometric exercising. These muscle contractions that define all sporting activities can be analyzed and developed by implementing isometric contractions at the more critical positions throughout the desired activity. Isometric exercising is largely overlooked when exercising due to the difficulty in implementing static contractions in the numerous positions needed for a comprehensive workout. The present invention is an exercise device which overcomes this disadvantage and addresses the findings of the studies by enabling their implementation. The separating of the arms with the single push bar, as opposed to the more common approach in the industry of having a single arm, anchored at the back and splitting the push bar, more closely approximates isotonic exercises used with free weights.

DESCRIPTION OF THE DRAWINGS

The invention will be better understood by considering the following detailed description taken in connection with the accompanying of drawings in which:

FIG. 2 is a cross sectional side view of the adjustable arm assembly.

FIG. 3 is a cross sectional side view detailing the push bar and the adjustable arm connection assembly.

FIG. 4 is a cross sectional side view of the exercise mechanism which shows the general layout of the major internal components. The illustrations 2, 3 and 4 are shown together on page 2 to relate how these major components of the Isometric Exercising Apparatus are interconnected.

FIG. 14 is a cross sectional end view along the line C—C in FIG. 19.

FIG. 15 is a cross sectional side view along the line A—A in FIG. 14.

FIG. 16 is a cross sectional end view along the line D—D in FIG. 19.

FIG. 17 is a cross sectional side view along the line B—B in FIG. 16.

DETAILED DESCRIPTION

Figure 1:
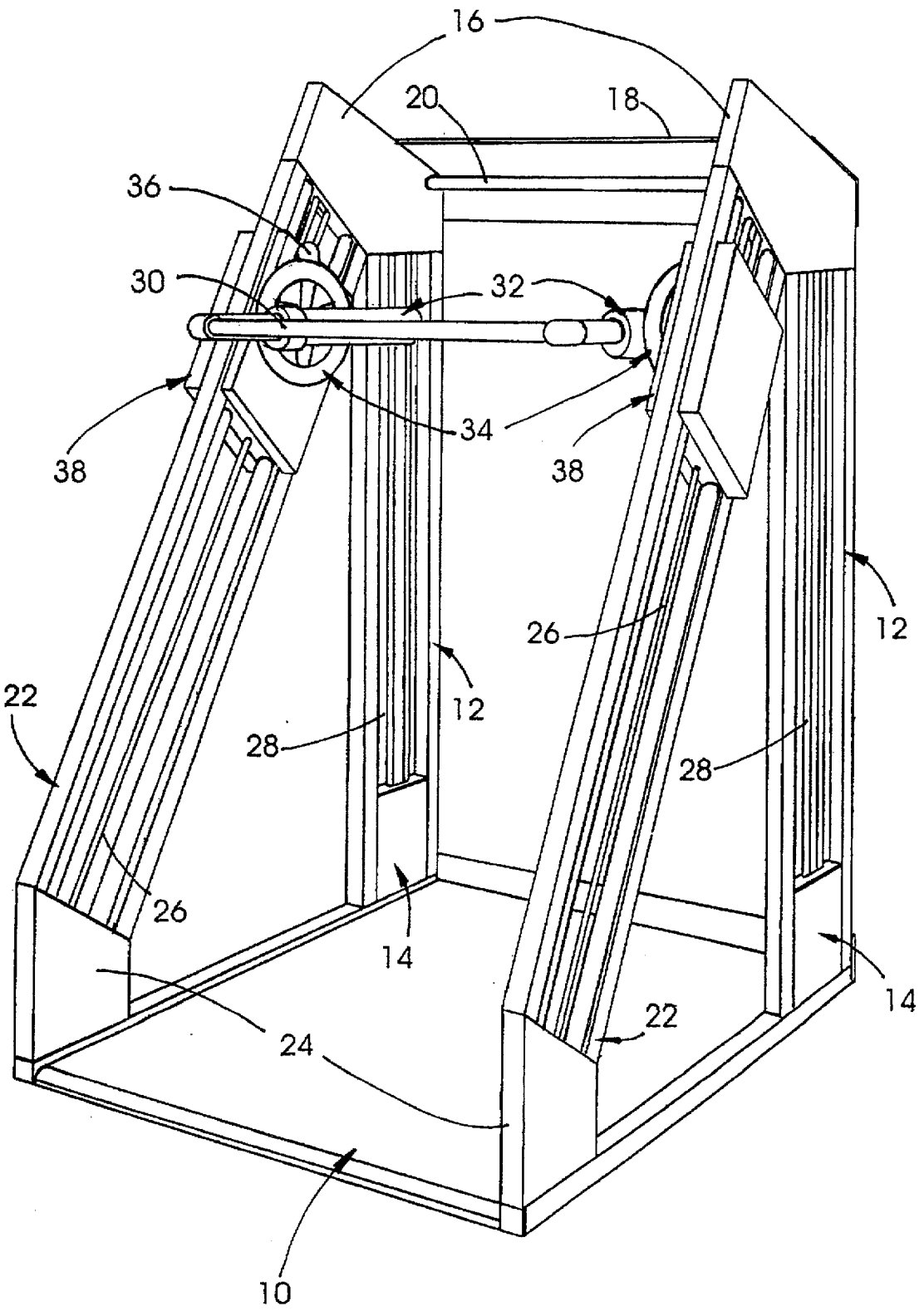
FIG. 1 is a front perspective view of the Isometric Exercising Apparatus, showing a general overview of the major components. In this drawing and throughout the other drawings it will be understood that labeling will proceed from the general to the detailed, as indicated in the following example, the base which in this drawing is labeled as number 10, when viewed in more detail in other drawings, the related components will be labeled 10A, 10B, 10C etc.

Referring now to FIG. 1, a perspective view of the exercising apparatus, this general layout shows the apparatus to consist primarily of a base 10 on which is anchored, at the rear, a pair of opposed upright support structures 12 that also act as tracks for the two exercise mechanism 38 counterweights 14. At the from of the base 10 are anchored a pair of opposed rectangular shaped casings 24 upon which are mounted a pair of 30 degree rearwardly angled support structures 22 that also act as tracks for the two exercise mechanism 38. The rear 12 and the front 22 structural supports are connected at the top by a pair of opposed octagonal shaped casings 16. The two sides are then connected by a cross support 18. The exercise mechanisms 38 are connected to the counterweights 14 by a roller chain 28 at the top and a cable 26 at the bottom. These systems are then adjusted taut to allow for fluid movement. These two systems are then connected at the top by an axle 20 with sprockets at each end, that mesh with the roller chain 28, allowing the two systems to move in unison up and down their respective tracks. The exercising apparatus framework is constructed from a variety of extruded aluminum shapes and cast components.

Figures 12, 13:
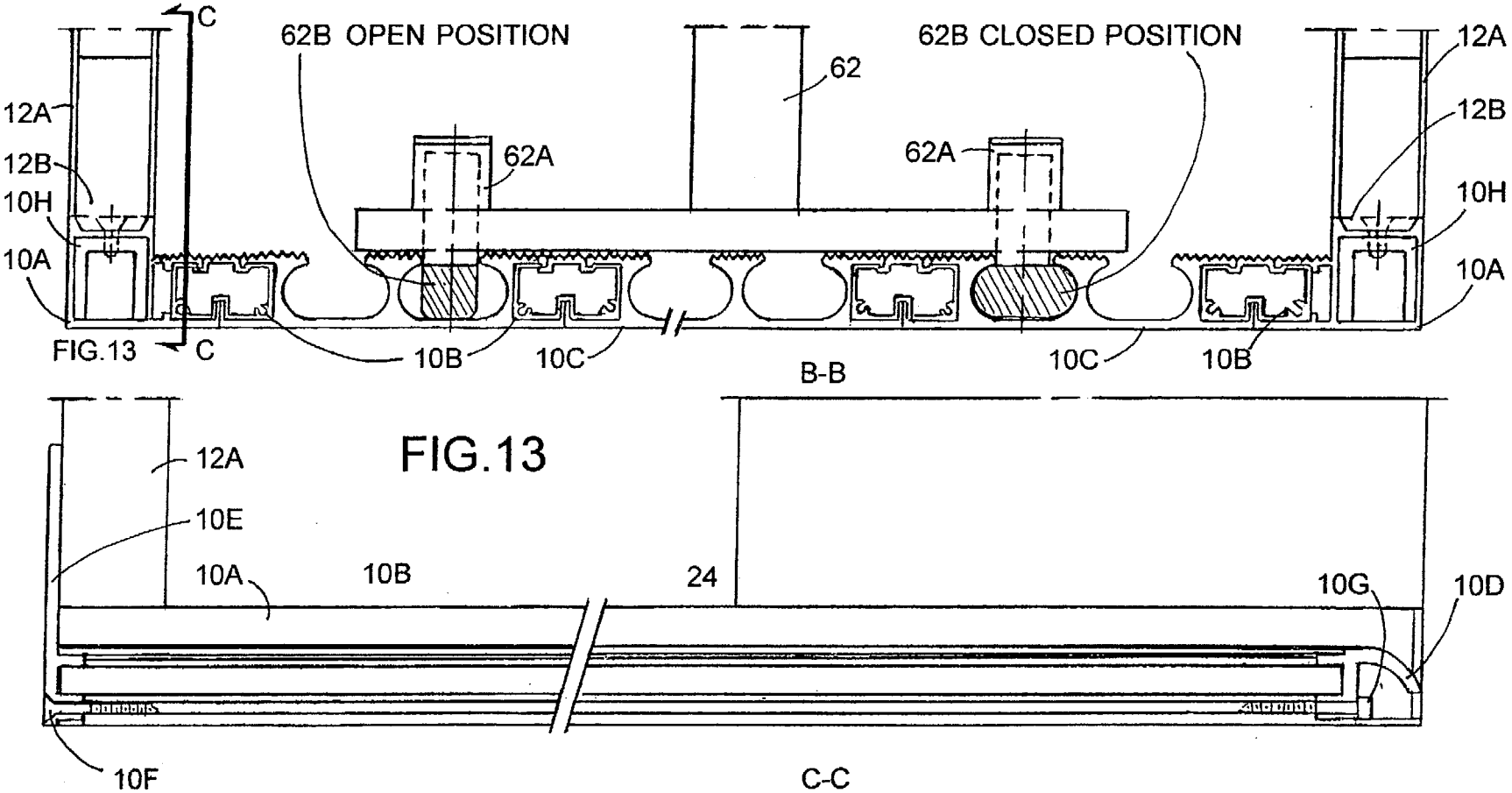
FIG. 12 is a cross sectional end view along the line B—B in FIG. 19 showing the components used in the construction of the base and other relative elements used in the Exercise Apparatus.
FIG. 13 is a cross sectional side view along the line C—C in FIG. 12.
Figure 19:
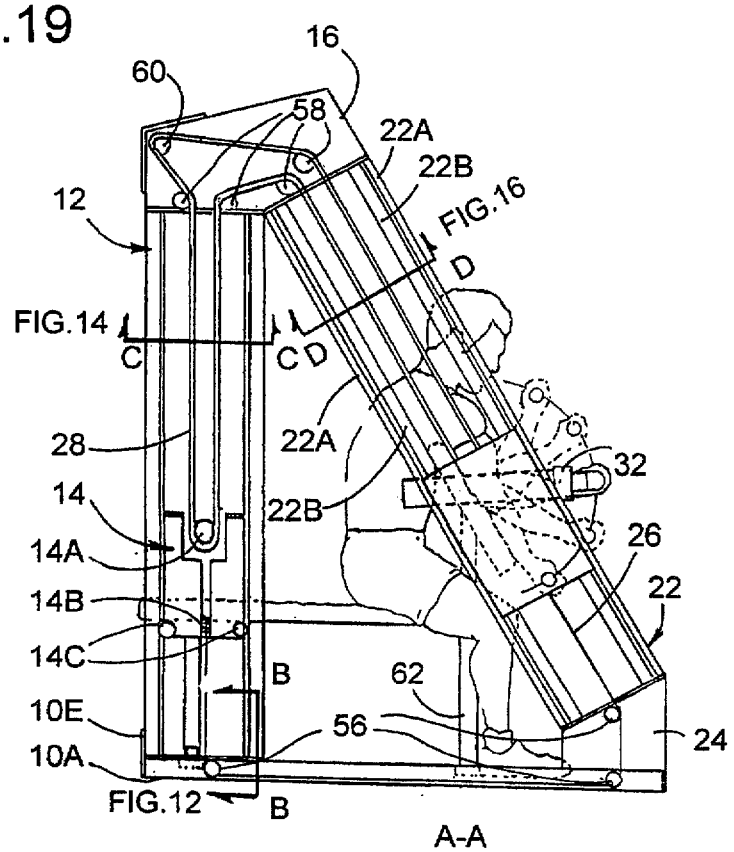
FIG. 19 is a cross sectional side view along the line A—A in FIG. 18.
Figure 20A:
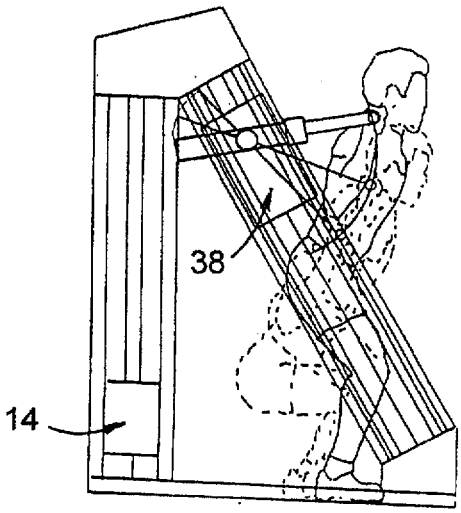
FIG. 20 A through F demonstrates the machine's versatility through a range of exercises.
Figure 20B:
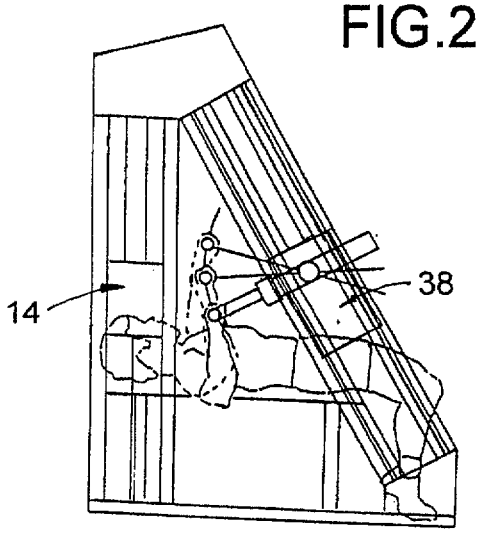
Figure 20C:
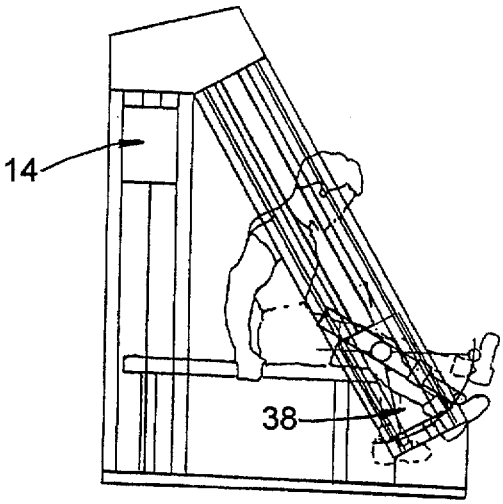
Figure 20D:
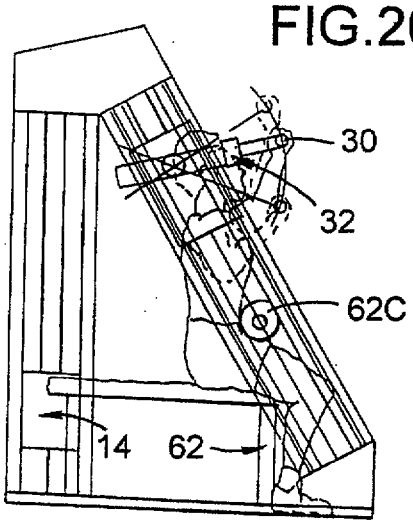
Figure 20E:
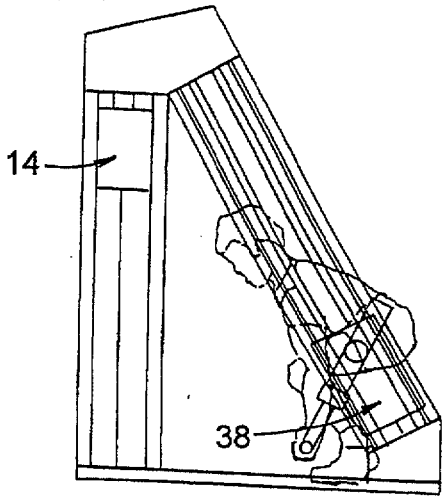
Figure 20F:
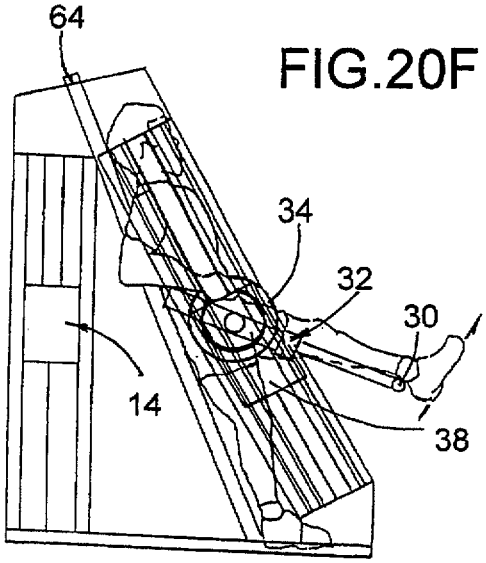

Now turn to FIG. 12, the cross sectional end view of the base 10 along the line B—B in FIG. 19. Illustrated in this cross section are the three extruded aluminum shapes, 10A, 10B and 10C, that make up the width of the base 10, the cast inserts 10H, four in all, the components 12A and 12B of the upright support structures 12 and how they interconnect. FIG. 13, the cross sectional side view of the base, along the line C—C in FIG. 12, illustrates the last two aluminum extrusions 10D and 10E. These two extrusions when bolted 10F and 10G to the extrusion 10B cap and unify the strength of the base 10. The cast inserts 10H are used to secure the upright structures, 12 and 24, to the base 10. Next, FIG. 14, the cross sectional end view of the counterweight track assembly, along the line C—C in FIG. 19, illustrating the extruded aluminum shape 12A and the cast insert 12B. FIG. 15, the cross sectional side view, along the line C—C in FIG. 14, demonstrates more clearly how these components are assembled. Finally, FIG. 16, the cross sectional end view, along the line D—D in FIG. 19 of the exercise mechanism track 22, illustrating the extruded aluminum shape 22A, the tube track 22B, upon which the exercise mechanism 38 moves and the cast inserts 22C, which when bolted to the extrusions 22A secures these components as a unit. FIG. 17, the cross sectional side view, along the line D—D in FIG. 16 demonstrates more clearly the assembly of these components. Next to be considered are the components which form the heart of the exercising apparatus, the exercise mechanism 38, the adjustable arms 32 and the push bar 30, upon which the exercises are performed.

For a more detailed description of these three components, referring to FIG. 2, a cross sectional view of the adjustable arms 32. Beginning with the T-shaped outer arm holder 32C, this part connects the outer steel tubing 32A of the adjustable arm 32 assembly to the torque ratchet mechanism 40 shown in FIG. 4. The adjustable arms 32 are comprised primarily of an outer steel tube 32A; held in place in the outer arm holder 32C by a set screw 32E, a beveled steel insert 32F pressed and set screwed 32I in place, a steel cup 32H with a fine thread on the inside that threads onto the outer threaded steel insert 32F, a split chamfered bushing 32G and the inner steel tubing 32B. The steel cup 32H when tightened presses the split bushing 32G chamfered surface against the beveled surface of the steel insert 32F causing the split bushing 32G to close clamping the inner steel tubing 32B solidly in place. The inner tubing 32B has a nylon bushing 32D, pressed on one end, that is snugly sized to the walls of the outer tubing 32A allowing, when repositioned, a slow smooth movement, due to a compressed air effect, within the outer tubing 32A. An L-shaped connector 32L, FIG. 3, is inserted into the inner tubing 32B and set screwed 32J in place. The L-shaped connector 32L is also connected to the push bar 30 and held in place by a set screw 32K.

Figure 5:
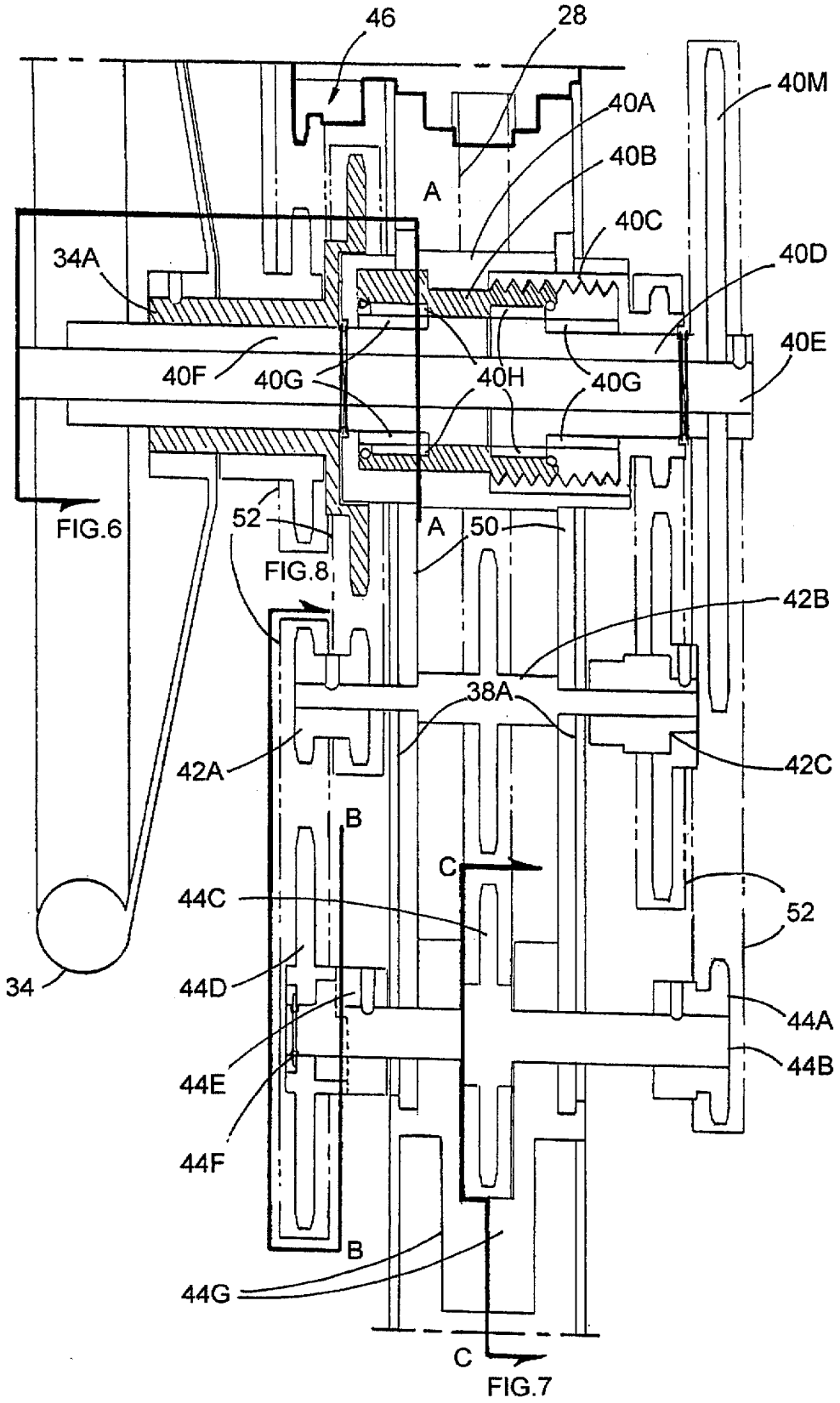
FIG. 5 is an enlarged area of FIG. 4 showing in greater detail the three components that facilitate the ratcheting and control capability of the device.

Turn now to FIG. 4, a cross sectional side view of the exercise mechanism 38, for a general layout of its main components. The mechanisms main components are as follows the torque ratchet assembly 40, the central sprocket configuration 42, the adjustable arm 32 braking mechanism 44 (all mounted on two reinforcement plates 50) the locking assembly 46 and the exercise mechanism cable 26 connector 48. These in turn are all mounted on the exercise mechanism's two inner housing panels 38A. For a more detailed view of the first three components and an explanation of their functional interaction turn to FIG. 5. The illustration in FIG. 5 is basically an enlargement of FIG. 4 showing in more detail the torque ratchet assembly 40, the central sprocket configuration 42 and the braking mechanism 44.

Figure 6:
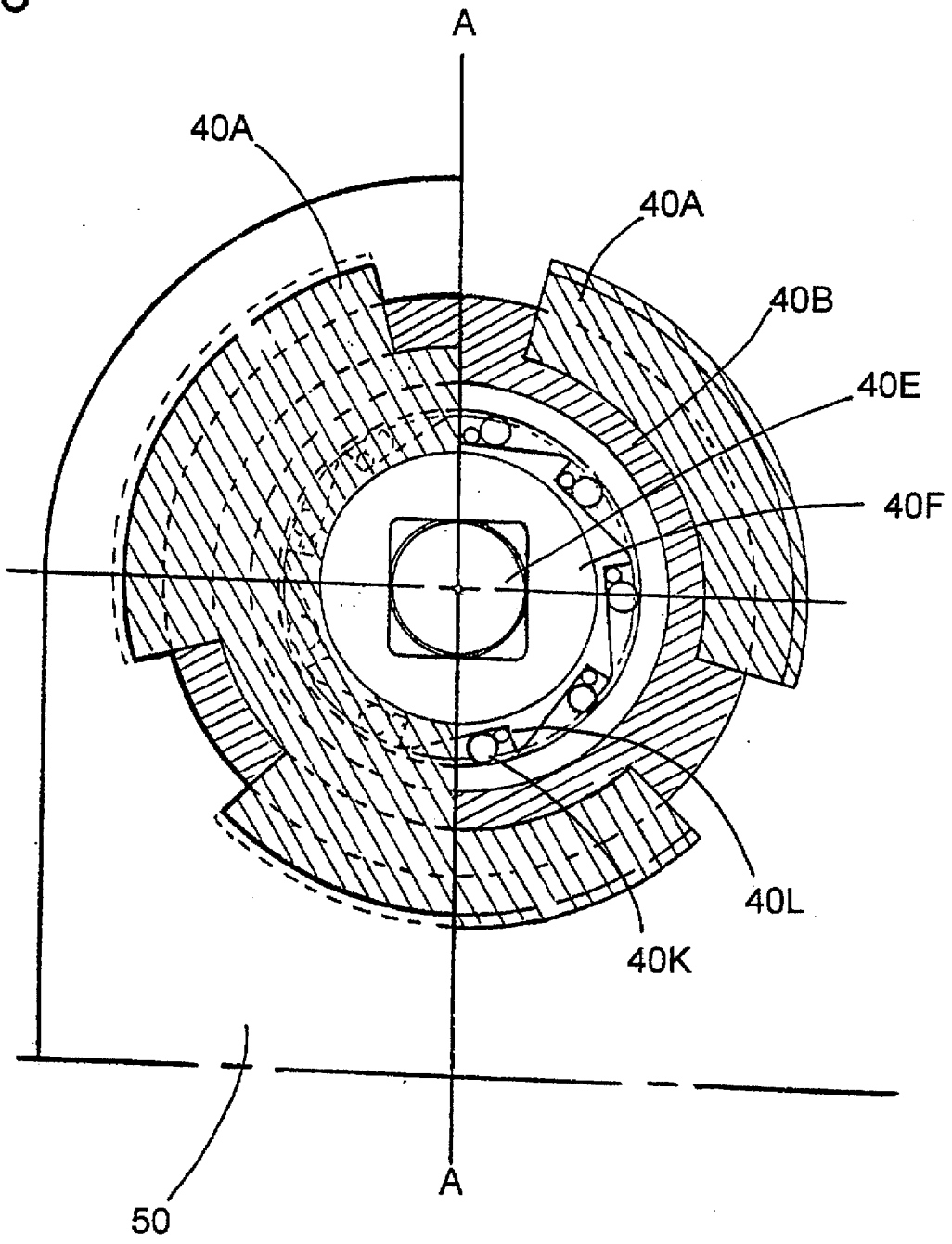
FIG. 6 is a front end view of the torque ratchet assembly cross sectioned vertically down the middle to the point indicated by the line A—A in FIG. 5, exposing the torque ratchet's internal components.

First, the torque ratchet assembly 40 is comprised of a slotted outer sleeve 40A which acts as a guide and a stop for the inner sleeve 40B, preventing the inner sleeve 40B, from turning when the two directionally opposed binding gear shafts 40D and 40F, in their turn, bind against the solid surface of the inner sleeve 40B. Turning to page 4, FIG. 6, a front end view of the torque ratchet assembly 40 cross sectioned vertically down the middle to the point A—A indicated in FIG. 5 showing in more detail these internal elements. In this diagram the slip bushing 40H and the retaining bushing 40G of FIG. 5 have been left out to reveal the binding gear shaft 40F and the binding elements, the needle bearings 40K and the nylon-tubes 40L, that hold the needle bearings against the inner sleeve 40B ratcheting surface. Also shown in more detail by this drawing are the slots in the outer sleeve 40A, the three raised sections of the inner sleeve 40B and how they key into these slots and finally how the reinforced plates 50 use these same slots to anchor in place the whole torque ratchet assembly 40. Turn back to FIG. 5. The inner sleeve positioner 40C, through the interconnecting threads, positions the inner sleeve 40B by being rotated. Rotation is initiated when its sprocket, mounted on the rear, is engaged through the sprocket configuration 42 of FIG. 4.

The sprocket configuration 42 acts as a connecting bridge between the wheel control 34, the torque ratchet mechanism 40 and the braking mechanism 44. Now turn again to FIG. 5 for a more detailed view of the sprocket configuration 42. This central unit is comprised of the sprocketed slip dutch 42C, the sprocketed shaft 42B, the dual sprocket 42A, which links the braking mechanism 44 and the wheel control by sprocket 34A. The main function of this group is to not only act as a central link but also in a gearing capacity. A ¼ turn on the wheel control 34 results in the inner sleeve positioner 40C rotating twice, effectively moving the inner sleeve 40B to the desired position which results in a change in the ratcheting direction. When the desired position is achieved the system continues to rotate in the same direction. This would result in the system seizing up at this point if it were not for the slip clutch sprocket 42C allowing the system to continue to rotate. The dual sprocket 42A provides the coupling between the wheel control 34 and the breaking mechanism 44 effectively closing the system. Finally the central sprocket on the sprocketed shaft 42B is used to connect the exercise mechanism 38 by roller chain 28 to the counterweight 14.

Turn to FIG. 19, a cross sectional side view along the line A—A in FIG. 12, to view the system that allows for both the movement up and down the track 22 of the exercise mechanism 38 and the looped roller chain 28 to circulate when the exercise mechanism 38 is locked in place. Starting at the top of the exercise mechanism 38 the roller chain 28 is looped around the central sprocket 42B then guided by four roller sprockets 60 and an axle 20 mounted sprocket 58 which connect the two separate systems on each side, then finally around the counterweight 14 sprocket 14A and back. At the bottom of the counterweight 14 is connected, through an adjustment bolt 14B, a cable 26 that runs through the extrusion 10A of the base 10 guided by rollers 56 which are mounted on the inserts 10H and the casings 24 and then connects to the bottom of the exercise mechanism 38 completing the circuit. This system is then adjusted taut by the adjustment bolt 14B which gives the system a tight fluid movement. Finally, the counterweight 14 is guided by the wheels 14C up and down the counterweight track 12, which effectively neutralizes the weight of the exercise mechanism 38, allowing for easy positioning.

Figure 7:
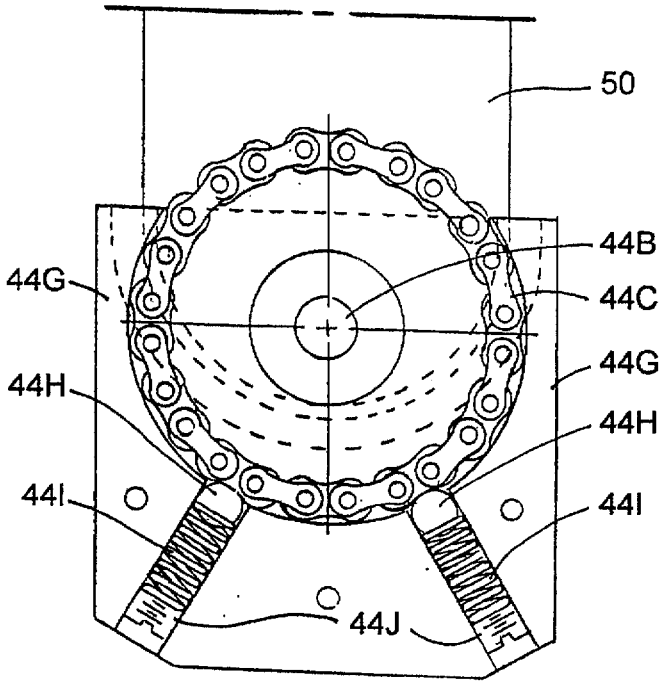
FIG. 7 is a front view of the braking assembly along the line C—C in FIG. 5.

Now on to the braking mechanism 44, FIG. 4. This configuration provides the resistance required to hold the adjustable arm 32 and push bar 30 in a set position and, through audible clicking, provides numerous precise locatable positions where isometric contractions may be performed against the push bar 30 over the entire range of an exercise, such as the arm curl, illustrated in FIG. 19. Again turning to FIG. 5 the adjustable arms 32 are connected to the braking mechanism 44 via the inner shaft 40E, the inner shaft's large sprocket 40M and finally by roller chain 52 to the sprocket 44A which is set screwed to the shaft 44B, whose central sprocket forms the heart of the braking mechanism 44. For a more detailed view of the braking mechanism's internal components turn to FIG. 7 for a cross sectional front view along the line C—C in FIG. 5. The sprocket integrated into the sprocketed shaft 44B, in conjunction with the roller chain 44C, acts as a stop when the ball beatings 44H are pressed into the chain's hollows by the springs 44I whose tension is adjusted by set screws 44J directed by the holes formed when the two halves of locking housing 44G, which are separately secured to the reinforcement plates 50, bolted together. Returning to FIG. 5 we see at the other end of the sprocketed shaft 44B another sprocket configuration made up of a secured hub 44E that is set screwed to the sprocketed shaft 44B. A sprocketed hub 44D is loosely placed onto the secured hub 44E and held in place by a clip ring 44F. This sprocket configuration is necessary due to the closed nature of this system resulting from the interconnecting system of roller chain 52 so that all the components of this system are constantly in play, allowing for movement in only one direction.

Figure 8:
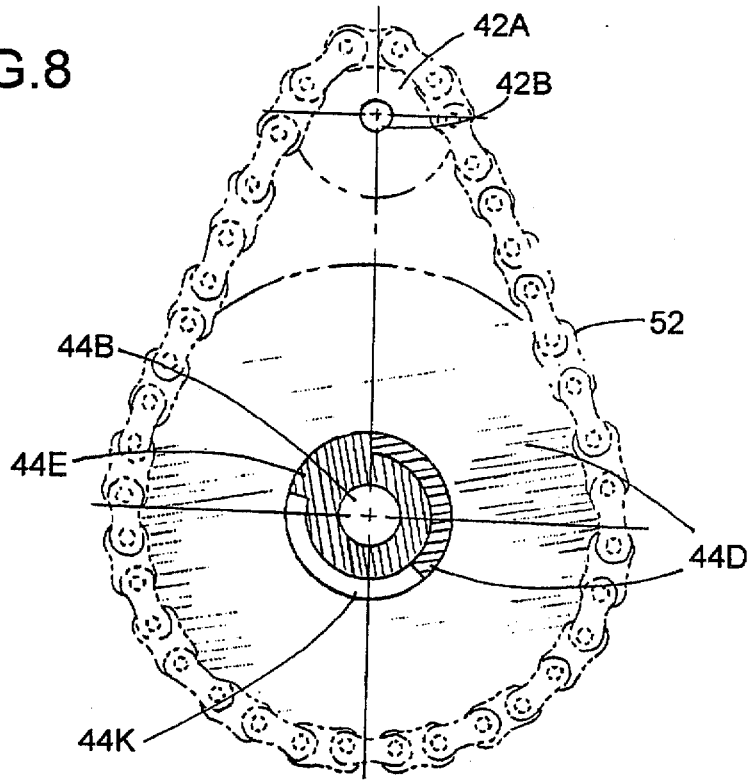
FIG. 8 is a cross sectional front view along the line B—B in FIG. 5 shown in relation to the sprockets used in this configuration.
Figure 9:
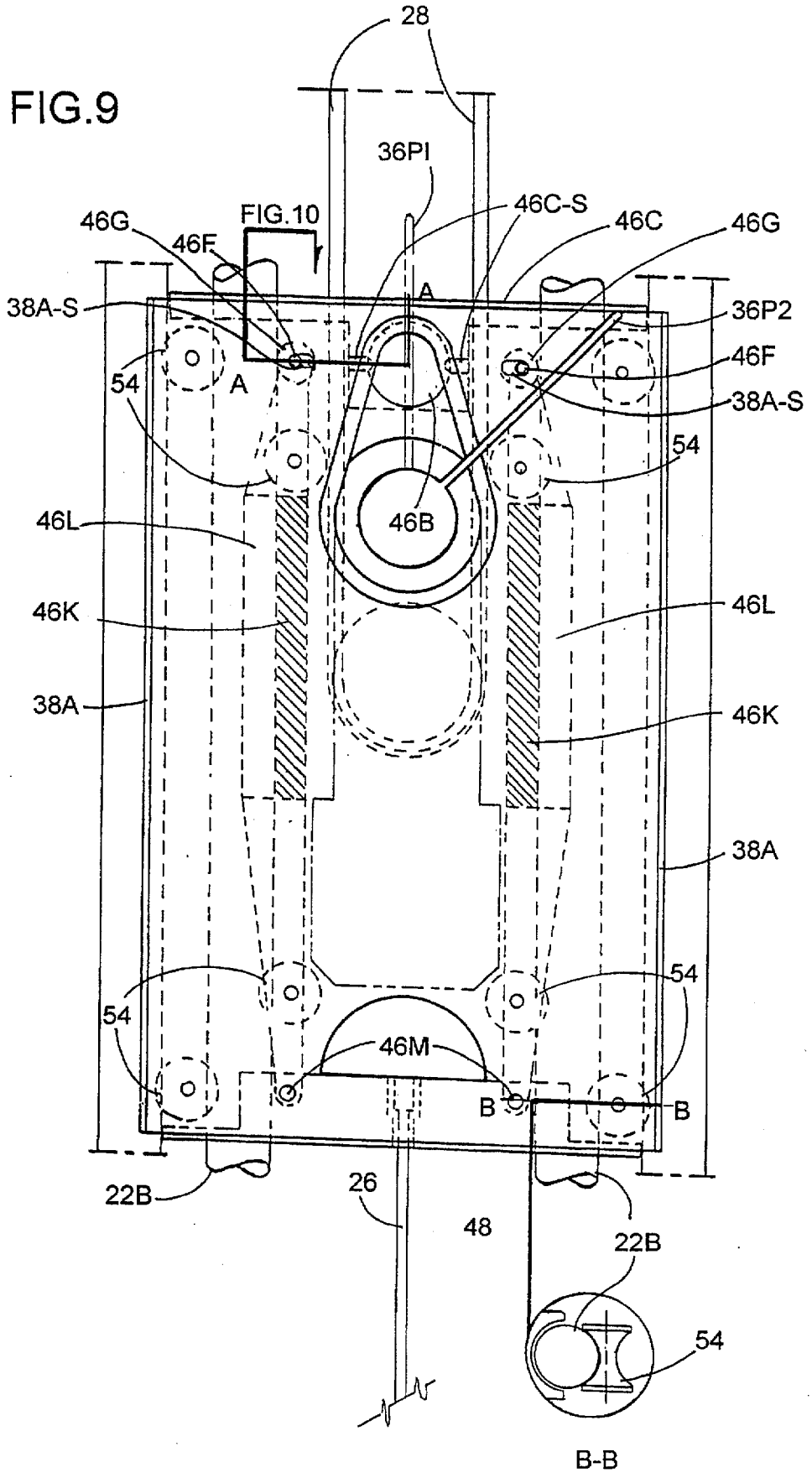
FIG. 9 is a front view of the exercise mechanism showing only the components involved in the movement and the locking of the exercise mechanism in place along the track.
Figure 10:
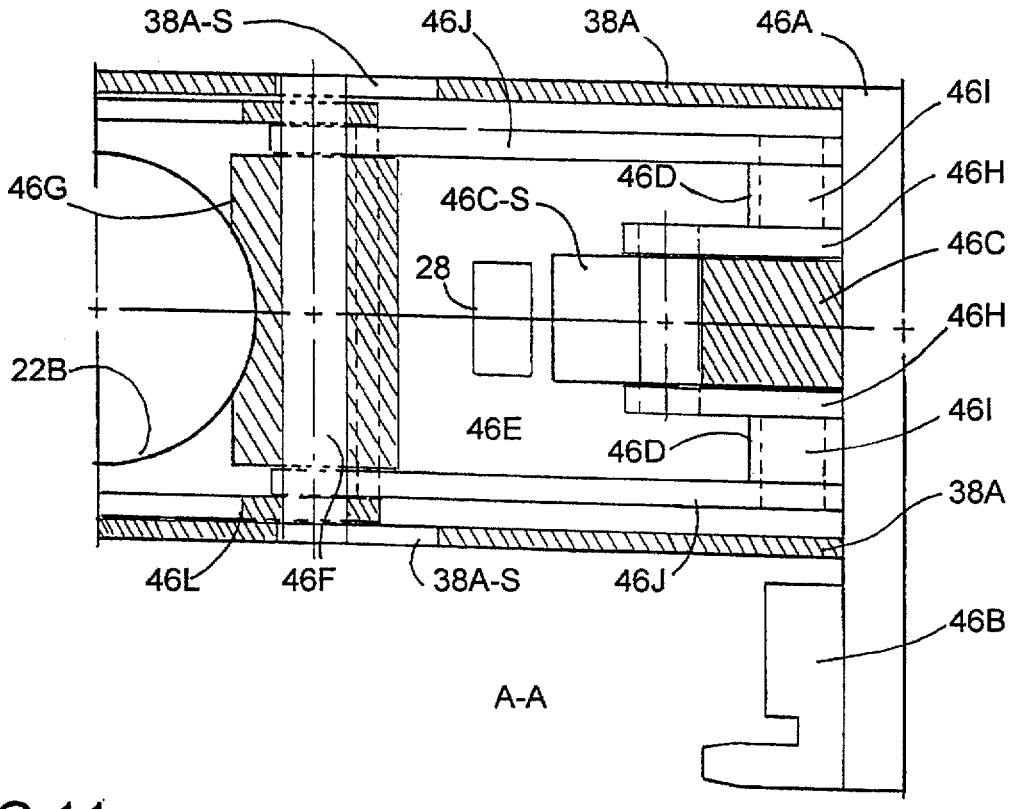
FIG. 10 is an enlarged cross sectional end view along the line A—A in FIG. 9
Figure 11:
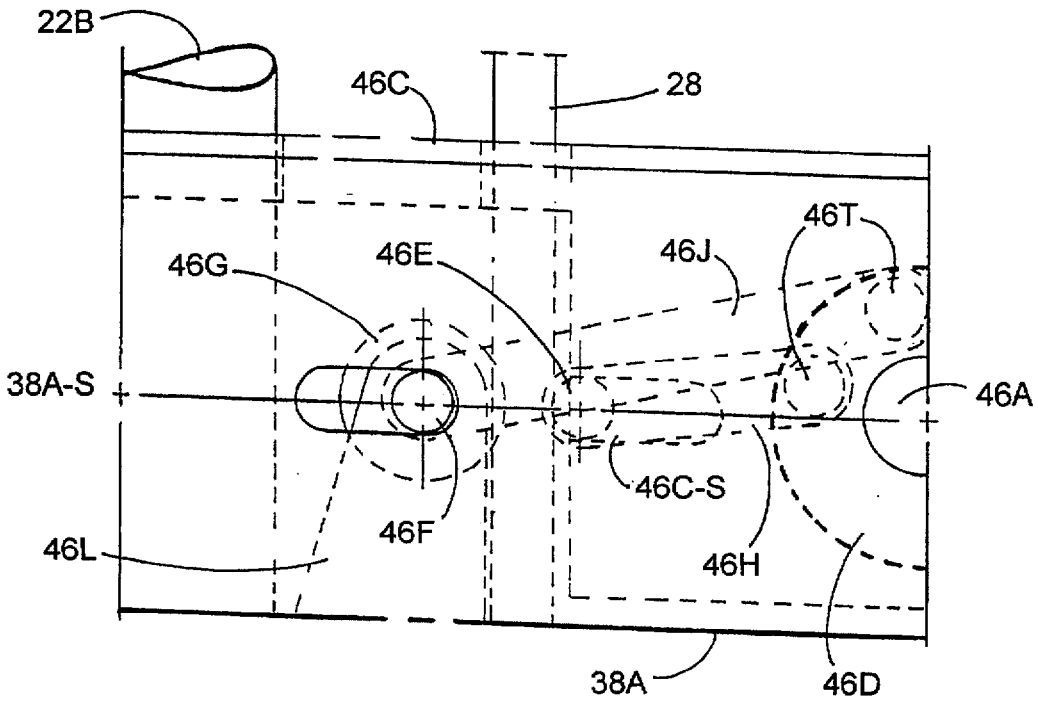
FIG. 11 is an enlarged side view of the same area shown in FIG. 10.

Now turn to page 5, FIG. 8. This drawing shows the interaction between the secured hub 44E and sprocketed hub 44D. When the sprocketed hub 44D is engaged by the wheel control 34, it moves around the secured hub 44E the distance allowed by the space 44K. This space 44K is large enough so that the wheel control has sufficient reverse movement to implement a change in the ratcheting direction. Furthermore, because of the gearing in this closed system, where a one pound force exerted on the wheel control 34 results in approximately 5 pounds at the adjustable arm 32 and push bar 30 assembly, gives the wheel control 34 a ratcheting capability. This capability allows the Exercise Apparatus to be utilized in another capacity which will be discussed latter. The next system of the Exercise Apparatus to be viewed and described is the exercise mechanism's locking system. Beginning at FIG. 4 the parts of this system shown are the locking assembly 46 and the exercise mechanism's cable connector 48. These and the other parts of the locking system are expanded upon in FIG. 9. In this diagram the other components of the exercise mechanism 38 are excluded. Shown are the components of the track 22, the two outer extruded aluminum shapes 22A and the two inner tubes 22B upon which the wheels 54 move the exercise mechanism 38 and against which the exercise mechanism 38 is locked. The locking lever 36 is shown in FIG. 9 as having two positions P1 and P2. Where P1 is the position in which the exercise mechanism 38 is allowed free movement up and down the track and P2 is the position which locks the exercise mechanism 38 in place. This locking results from the activation of the locking mechanism 46 in FIG. 4 by the interaction of the sprocket on the locking lever 36 with the sprocket 46B of the locking mechanism 46. The locking mechanism 46 engages the two opposed brake assemblies 46L, which are anchored at the base to the exercise mechanism cable connector 48 by two bolts 46M, forcing their rubber pads 46K against the track's tubes 22B, locking the exercise mechanism 38 in place. Now refer to FIG. 10, a cross sectional end view along the line A—A in FIG. 9, of the locking mechanism in the locked position. FIG. 11 is a side view of this same area, except the locking mechanism is in the unlocked position. The following detailed description will be better understood if both these illustrations are referred to together. Now the locking mechanism 46 components are as follows: the camshaft holder 46C holds the central shaft 46A, the spheres 46D are set screwed to this shaft and function as cams, and the sprocket 46B is connected by roller chain 52 to the locking lever 36. Now, attached by pins 46I to these two spheres 46D are two pairs of arms 46H and 46J. One pair on the inside and one pair on the outside. Attached then to the other end of the inner arm 46H is an axle 46E that is moved against or away from the roller chain 28; guided by a slot 46C–S in the central section of the camshaft holder 46C, by the action of the locking lever 36.

Attached to the outer arms 46J is the axle 46F, upon which is placed a soft rubber bumper 46G. This axle 46F is loosely connected to the brake assembly 46K which is moved against or away from the tube 22B, guided by slots 38A–S in the inner housing panels 38A, again by the action of the locking lever 36. The action of the outer arms 46J and the action of the inner arms 46H are opposite one another. When the outer arm assembly moves against the track's tube 22B, the inner arm assembly moves away, effectively fleeing the roller chain 28 and locking the exercise mechanism 38 in position at which point one is able to perform the desired exercise. Conversely when the outer arm 46J assembly moves away from the track's tube 22B, the inner arm 46H assembly moves toward the outer arm 46J assembly effectively pinching the roller chain 28 against the soft rubber bumper 46G, locking the ratcheting system but allowing the exercise mechanism 38 free movement up and down the track 22. This adds an element of safety to the Exercise Apparatus, requiring that both sides must be locked in order for the apparatus to function.

Figure 18:
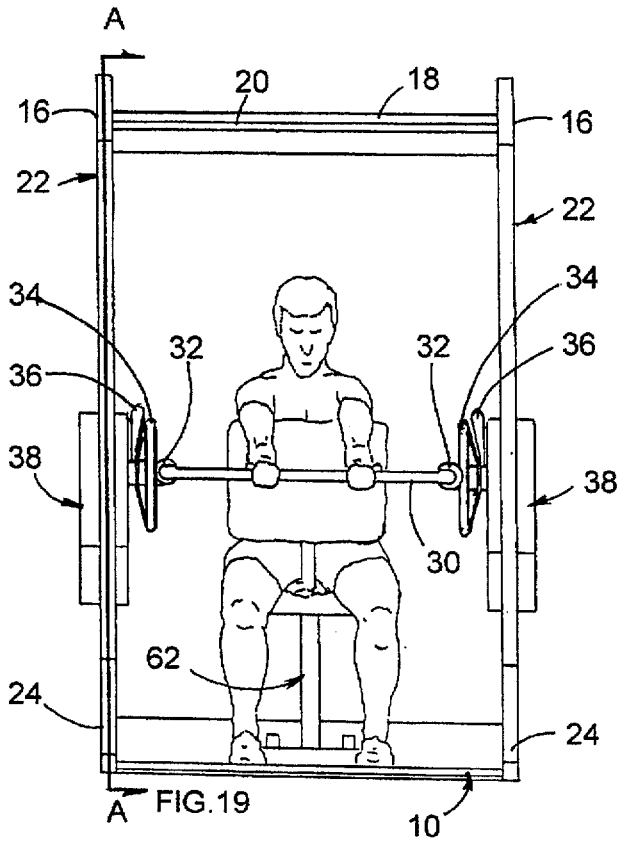
FIG. 18 is a front view of the Isometric Exercising Apparatus being used in the curl exercise relating the overall size of the device to an average sized male.
Figure 21:
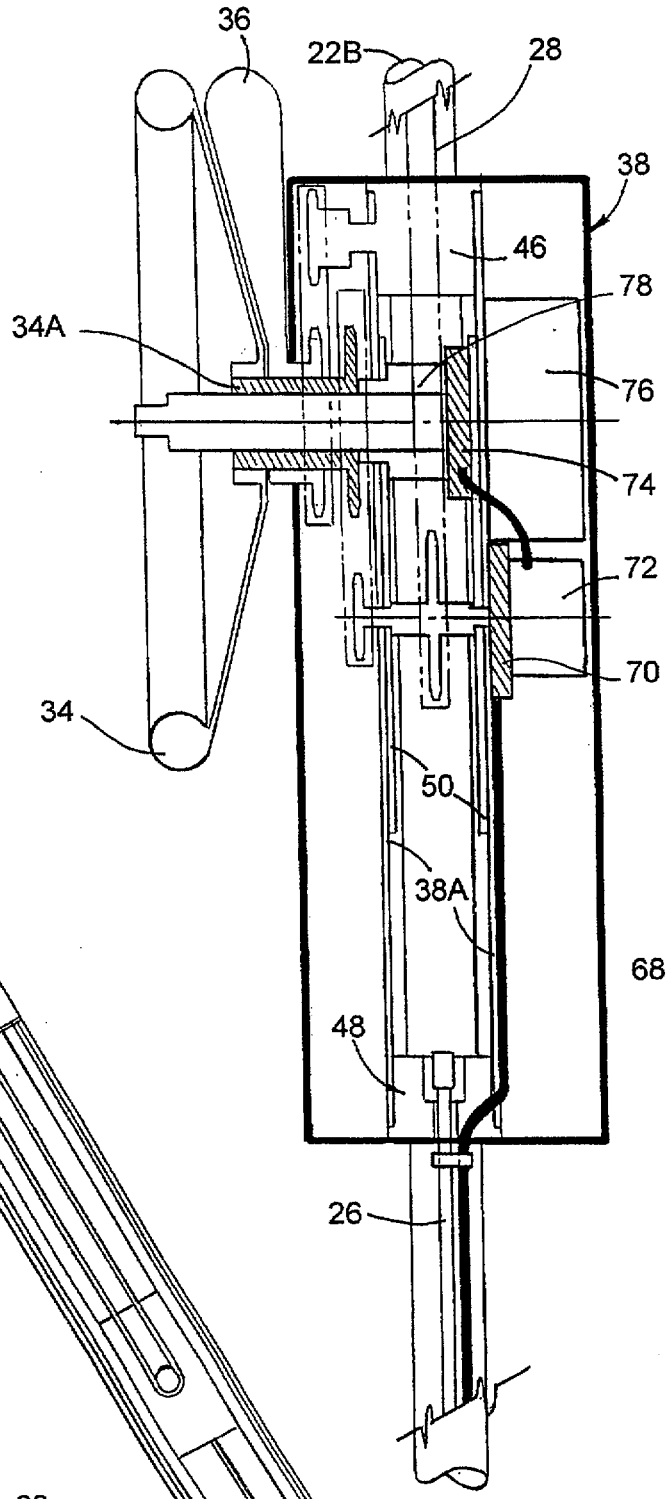
FIG. 21 A cross sectional side view of the Exercise Mechanism equipped with an electronically configured ratcheting and control system.
Figure 22:
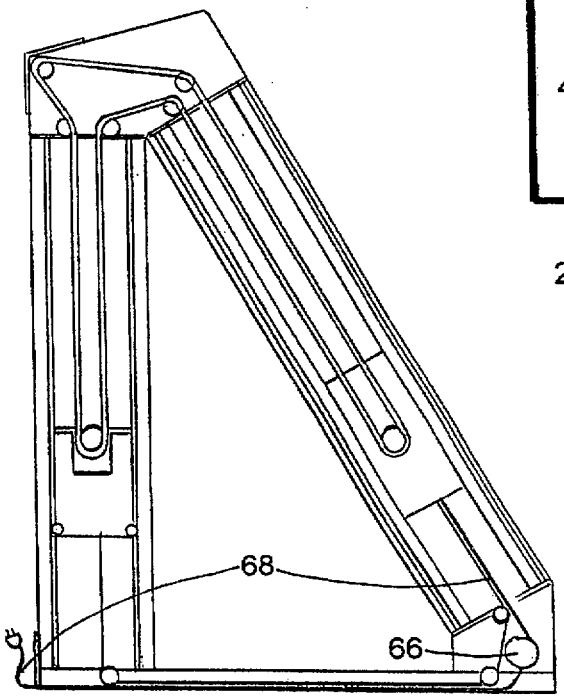
FIG. 22 A cross sectional side view along the line A—A in FIG. 18 with the addition of the electrical harness used with the electronically configured exercise mechanism in FIG. 21.

Now turn to FIG. 21 for an alternate means of implementing the functional capabilities of the previously detailed exercise mechanism. In this layout the torque ratchet assembly, the slip clutch and sprocket, the dual sprocket and the breaking mechanism have been replaced by a geared solenoid assembly 76 that will provide the sufficient torque needed and a system of electronic switches 70, 72 and 74, that provide the control needed, the electrical harness 68 and a torque shaft guide 78. The wheel control is still used to implement the change in direction of the adjustable arms and push bar assembly, except the control is implemented by the electronic switches 70 and 72. The first switch, the directional control switch 70 is sprung, returning the control assembly to a central position while the electronic timer 72 remains set to function in the chosen direction. Pushing the directional control switch 70 farther over-rides the electronic timer and activates the solenoid, resulting in continuous movement in the same chosen direction. When the wheel control is released the switch returns to the central position releasing control back to the electronic timer. The electronic timer 72 basically controls the length of time power is allowed to flow to the solenoid that results in the adjustable arm 32 push bar 30 assembly moving a measured distance. This function of the electronic timer 72 is controlled by the solenoid sprung control switch 76 which activates the electronic timer 72 by pressure being placed upon the push bar, in the range of 10 to 15 pounds. The push bar 30 then moves the distance allowed by the electronic timer 72 where the geared solenoid assembly 74 locks and the isometric contraction can be performed. When the pressure against the push bar is discontinued the solenoid sprung control switch 76 is reset allowing the electronic timer 72 to be reactivated. Finally FIG. 22 a cross sectional side view along the line A—A in FIG. 18 showing the electrical harness 68 and the electrical cord winding mechanism 66 that allows the electrical cord to move in and out matching the movement of the exercise mechanism 38.

The foregoing has basically described the construction and how all the components of the exercise apparatus function. Now the versatility of the apparatus is illustrated FIG. 18 and FIG. 19, together illustrate the size of the apparatus compared relative to an average sized male (5'8", 160 lb) while performing the arm curl exercise. FIG. 20, A through F, illustrates a small sample of exercises that may be performed on the apparatus.

A demonstrates the squat.

B demonstrates the bench press.

C demonstrates leg curls.

D demonstrates the pull up which differs from the other exercises in that, where the other exercises push the bar 30 away from the base 10, this exercise requires the bar 30 to be pulled toward the base 10. This requires some additional attachments in order for the exercise to be performed. Turn to FIG. 12, where is illustrated how the bench 62 is anchored to the base 10 by T-shaped legs 62B that when in position 62B-1 slip into the extrusions of the base 10 and when turned by the top portion 62A of the T-shaped legs 62B to position 62B-2 results in the bench being locked to the base 10. Turning back to FIG. 20-D we see an attachment 62C to the bench 62 holding down the user and allows the exercise to be performed.

E demonstrates the dead lift.

F demonstrates a stretching exercise that is utilized by dancers, gymnasts or anyone requiring the flexible strength to lift their legs over their heads or as high as possible. The leg, as demonstrated by the diagram, is ratcheted up using the gearing capacity designed into the exercise mechanism's 38 system of sprockets that connect the wheel control and the adjustable arms 32 push bar 30 assembly as explained previously. With the back placed against the incline board 64 and the leg placed on the push bar 30, the wheel control is rotated toward the user resulting in the leg being raised, isometric contractions being performed periodically over the tolerable stretching range.

The embodiments of the invention in which an exclusive property or privilege is claimed are defined as follows:

1. An isometric exercise apparatus comprising:

a framework defining a pair of parallel slanted exercise tracks and a pair of inclined tracks;

a pair of exercise mechanisms, each mounted for movement along a respective slanted track;

means for locking the exercise mechanisms in position along the slanted tracks;

a pair of arms, each pivotally mounted to a respective exercise mechanism;

the exercise mechanisms including a means for locking the arms in any of a plurality of angularly spaced positions;

a push bar connecting the arms for the user to engage in isometric exercise;

a pair of counterweights for countering the force of gravity on the respective exercise mechanisms mounted for movement up and down the inclined tracks; and a pair of roller chains engaging sprockets at the tops of each exercise mechanism and its counterweight, a cable connecting the bottoms of each exercise mechanism and its counterweight, and a sprocketed axle engaging each roller chain to provide for fluid movement of the exercise mechanisms substantially in unison along the slanted tracks.

2. The isometric exercise apparatus of claim 1 wherein the means for locking the arms in any of a plurality of angularly spaced positions comprises a torque ratchet.

3. The isometric exercise apparatus of claim 1 wherein the means for locking the arms in any of a plurality of angularly spaced positions comprises a geared solenoid.

4. The isometric exercise apparatus of claim 1, further comprising a bench for supporting the user.

* * * * *